US009557019B2

(12) United States Patent
Mahr

(10) Patent No.: US 9,557,019 B2
(45) Date of Patent: Jan. 31, 2017

(54) TEMPORARY WORK LIGHT STRING WITH VARIABLY-POSITIONABLE AND RE-POSITIONABLE READILY-REPLACED LAMP, OPTIONALLY WITH INTEGRAL HANGERS, THAT ARE OPTIONALLY ELECTRICALLY CONNECTED TO PLURAL ELECTRICAL CIRCUITS

(71) Applicant: Casey James Mahr, Postville, IA (US)

(72) Inventor: Casey James Mahr, Postville, IA (US)

( * ) Notice: Subject to any disclaimer, the term of this patent is extended or adjusted under 35 U.S.C. 154(b) by 418 days.

(21) Appl. No.: 13/986,645

(22) Filed: May 20, 2013

(65) Prior Publication Data

US 2014/0340903 A1 Nov. 20, 2014

(51) Int. Cl.

| | |
|---|---|
| ***F21S 4/00*** | (2016.01) |
| ***F21V 23/00*** | (2015.01) |
| *F21V 15/02* | (2006.01) |
| *F21W 131/10* | (2006.01) |

(52) U.S. Cl.

CPC ..... *F21S 4/001* (2013.01); *F21S 4/10* (2016.01); *F21V 23/001* (2013.01); *F21V 15/02* (2013.01); *F21W 2131/1005* (2013.01)

(58) Field of Classification Search

CPC ..... F21S 4/001; F21S 4/10; F21S 15/02; F21S 23/001; F21V 23/001; F21V 15/02; F21V 4/10; F21W 2131/1005

USPC ..... 362/391, 407, 652, 658–659

See application file for complete search history.

(56) References Cited

U.S. PATENT DOCUMENTS

| | | | | |
|---|---|---|---|---|
| 6,758,578 | B1 * | 7/2004 | Chou | 362/647 |
| 7,114,841 | B2 * | 10/2006 | Aanegola et al. | 362/640 |
| 2008/0112169 | A1 * | 5/2008 | Cunius | 362/250 |
| 2013/0201658 | A1 * | 8/2013 | Bogart | F21S 4/001 362/95 |

* cited by examiner

*Primary Examiner* — Laura Tso
*Assistant Examiner* — Naomi M Wolford
(74) *Attorney, Agent, or Firm* — Shuttleworth & Ingersoll, PLC; Jason Sytsma

(57) ABSTRACT

A work light string removably physically mounts and electrically attaches lamps anywhere along it is length, with ready hand positioning and re-positioning of desired numbers of lamps at desired positions, and replacement of damaged lamps. The work light string can have one, or, more preferably two separate electrical circuit in which case each lamp and any external electrical load(s) can be powered by either circuit.

4 Claims, 3 Drawing Sheets

TEMPORARY WORK LIGHT STRING WITH VARIABLY-POSITIONABLE AND RE-POSITIONABLE READILY-REPLACED LAMP, OPTIONALLY WITH INTEGRAL HANGERS, THAT ARE OPTIONALLY ELECTRICALLY CONNECTED TO PLURAL ELECTRICAL CIRCUITS

BACKGROUND OF THE INVENTION

1. Field of the Invention

The present invention generally concerns a portable cord, also known as portable cordage, for temporary deployment that attaches, permissibly among other things, temporary work lamps, or lights, along its length, thus nominally a "temporary work light string".

The present invention particularly concerns (1) the positioning of lamps, or lights, along the length of a temporary work light string, and (2) the management of electrical circuits within a temporary work light string and within any devices, including lamps or lights, that are electrically connected to such temporary work light string.

2. Background of the Invention 2.1 Portable Cords

The present invention will be seen to involve a portable temporary power cord, or cable, that can physically attach and electrically connect along its length, among other things, work lamps.

According to the entry "Portable Cord" appearing circa 2012 in Wikipedia, the free encyclopedia of the Internet, "[a] portable cord, which is also known as portable cordage or flexible cord, is a cable with multiple conductors used for functions requiring flexibility. The cord can be employed for power in a range of applications, such as operating motors in small and large tools, equipment, power extensions, home appliances and machinery.

"Portable cords may be used in commercial, industrial and residential applications. They work well on job sites where resistance to oil, chemicals and abrasion is vital and also perform well in extreme environments—both the heat and the cold, outside or inside. Additionally, some portable cords can be water-resistant or water submersible. Because of their characteristics, portable cords are commonly used in a range of facilities, such as construction sites, mills, mines, sports complexes, or even marinas.

"Although the construction of a portable cord varies depending on the type, a standard cord has at least two stranded copper conductors. The copper stranding, insulation and jacket directly influence the physical properties of the cord."

The most preferred cord material of the present invention will be seen to be Type SEOW. Continuing in the Wikipedi entry:

"A variety of portable cords, differing in styles, lengths and thicknesses, exist in the marketplace. Common types include Type SJT, SVT, SEOW, SJ, SJOW, SO and SOW. Each has specific applications associated with it. A portable cord is usually made of thermoset, thermoplastic elastomer, or thermoplastic. Thermoset cords have heavy-duty-grade rubber jackets and are extremely sturdy. Thermoplastic elastomer cords have medium-duty-grade thermoplastic elastomer jackets and perform well in cold conditions. Thermoplastic cords have a light-duty plastic compound jacket and thus work for light-duty use."

The preferred Type SEOE is a Thermoplastic elastomer (TPE). As explained in the 2000 article "Don't Let Your Portable Cord Tie You Up" appearing on the World Wide Web at the Electrical Construction and Maintenance website, "[t]hese cords have medium-duty-grade thermoplastic elastomer jackets. UL designations for these cords are SEOW-A and SJEOW-A. CSA designations for these cords are STW and SJTW-A.

"TPE compounds are lightweight in comparison to the rubber materials . . . [found] in thermoset cords. Approved for indoor and outdoor use, TPE is a better choice than plastic materials for some commercial outdoor construction in northern regions. It performs well in cold temperatures (−50 degrees Celsius/−58 degrees Fahrenheit). You'll see this type of material in some standard extension cords.

"TPE cords resist water, oil, cuts, chemicals, and acid. They also handle exposure to weather, sunlight, and ozone. You can get these in a flame-retardant version. However, the CSA designation for this type of cord (STW) carries no recognition for oil resistance. The agency marks this cable as a "T" type, thermoplastic: a plastic compound.

"Although manufactured like a thermoset product and able to perform in temperatures up to 105 degrees Celsius/221 degrees Fahrenheit, TPE may not stand up in environments where extreme heat and hot oil are factors. When exposed to such circumstances, the cord may disfigure or melt, making it useless.'

2.2 Limitations of Previous Portable Temporary Power Cords

Previous portable temporary power cords attach lamps in fixed positions along the length of the cord, normally at even spacing after an initial interval from the plug that is typically longer than is the space between lamps. Such a construction is, almost by definition, likely unsuitable in detail for the illumination of the interior spaces, or rooms, of a building which rooms are typically not linear, and which are accessed through doors and windows at which points lamps may be inappropriate for, among other reasons, shining in the eyes of persons passing or looking through such portals.

More troublesome than sub-optimal lamp locations are the quite frequent occurrences during construction when more light is needed at a specific location. This entail moving the whole work light string, and all or most of the lamps along it. Reasons for moving the string include so as to prevent the lamps from becoming buried or enclosed or trapped above equipments, avoidance of suspended ceilings and/or of framing and/or of dry wall, or prevention of capture between walls. The operation of moving an entire light string so as to move and relocate but a single lamp may become labor intensive and may even require the labor of more than one person.

Further, and more seriously, lamps that are located in fixed positions along the length of a temporary power cord most typically cannot be replaced if damaged. The only alternative to discarding the entire work light cord is to cut out a damaged light and splice the cord back together in an improved manner, typically leaving both an undesirable bulge on the cord and dimensional unevenness in the location of lights along the cord. This repair requires materials and time, and is seldom done even by skilled electricians upon their own work light cords.

Finally, existing work light cords are normally connected to but a single electrical circuit, which is normally rated at 20 amperes/This means, as a practical matter, that the largest and longest work light strings are no more than ten 100-watt light bulbs, and 100 feet in length. Moreover, the ability to power additional loads from these work light cords—such as at a receptacle at the end of the cord o by screwing into an Edison socket normally taking an light bulb—is limited. It would be useful if the lengths, current capacities, and/or flexibility (in numbers and in positions of the attachment(s) of electrical loads to a work light cord could be improved.

SUMMARY OF THE INVENTION

The present invention contemplates an improvement to a temporary work light string having (1) a flexible electrical cord, or cable, physically mounting and electrically connecting (2) lamps, or lights, along its length wherein the powered lamps are variably positionable, and re-positionable, and readily-replaceable along the length of the cord or cable.

The present invention further contemplates that a temporary work light string should be based on an electrical cord, or cable, containing a plurality of separate electrical circuits, normally two such circuits. Each circuit serves to power those electrical devices, particularly including lamps or lights, to which it is electrically connected.

1. A Work Light String with Variably-Positionable Lamps or Lights

Accordingly, in one of its aspects the present invention is embodied in a work light string having variably-positionable lamps or lights.

The string includes (1) a flexible electrical cord/cable, pluggable to electric power at a one end thereof, physically mounting and electrically connecting (2) a plurality of lamps/lights along its length. The lamps/lights are variably positionable, and re-positionable, and replaceable along the length of the cord/cable at a time after the manufacture thereof, and without severing and splicing the cord/cable.

The cord/cable so performing has both (1) external insulation and (2) internal conductors where the (1) external insulation is penetrable by a pressured metal prong or blade to make electrical contact with an (2) internal conductor.

The (1) penetrable external insulation of the cord cable is preferably self-healing upon the withdrawal of any metal prong or blade so as to squeeze shut any penetrating hole made by the metal prong or blade. the cord/cable having self-healing penetrable external insulation is most preferably Type SEOW.

The variably positionable, re-positionable and replaceable lamps light along the length of the cord/cable preferably include (1) a first-part assembly suitable to hold an electric lamp to which electrical connection is made by a one, first, end of at least two metal conductors within the assembly, screwed to (2) a second-part assembly. The first- and the second-part assemblies defining between them a channel into which the cord/cable is laid. The at least two metal conductors of the first-part assembly terminate at their second ends in at metal prongs/blades that are within the channel and suitably positioned so that when the first- and the second-part assemblies are screwed together then these at least two metal prongs/blades will under compression force penetrate the external insulation of the cord-cable that is positioned within the channel, and will make electrical connection between at least a power, and a ground, electrical circuit of this cord/cable and the lamp.

Since the physical and the electrical connection of the cord/cable to the lamp did not depend upon any properties of the cord-cable, nor of the assemblies, that were unique to the point of connection, then the assemblies, and the held lamp, are variably positionable anywhere along the length of the cord/cable.

The first-part assembly can preferably be unscrewed from the second-part assembly so as to free the cord/cable held between them, and so as to break and electrical connection of the electrical circuits of the cord/cable to the lamp, without damage to either the cord/cable nor the assemblies, leaving both assemblies and cord/cable suitable for reuse.

The first-part assembly can optionally hold the electric lamp in an Edison screw socket that nominally holds an incandescent light bulb—although other sockets for other bulbs such as of the compact fluorescent and Light Emitting Diode ("LED") types are eminently suitable. When the Edison screw socket is used (for a bulb of any type) then the electric lamp is replaceable in the first-part assembly by screwing, and the first- and second-part assemblies are replaceable on the cord/cable also by screwing. Accordingly the entire work light string assembles, and disassembles, by screwing. All this screwing is most preferably accomplished solely under force of the hands and fingers.

The second-part assembly preferably further includes a hanger feature that can be used so as to hang (1) all of the second-part assembly, (2) the first assembly and its held lamp to which the second-part assembly is screwed, and (3) a regional portion of the cord/cable held between the first- and second-part assemblies.

This work light can optionally be configured so that its cord/cable contains three electrical conductors side-by-side: one outside conductor being a hot line of a first electrical circuit, the center conductor being an electrical neutral, and the remaining outside conductor being the hot line of a second electrical circuit separate from the first electrical circuit. The two metal prongs/blades of the first-part assembly of the variably positionable, re-positionable and replaceable lamps can be oriented so as to forcibly penetrate the cord/cable insulation, and to make electrical connection with the first electrical circuit only, or can alternatively be oriented so as to forcibly penetrate the cord/cable insulation, and to make electrical connection with the second electrical circuit only. Accordingly (1) the cord/cable contains two separate electrical circuits; and (2) each positionable, re-positionable and replaceable lamp can be electrically connected to either electrical circuit of the cord/cable.

2. A Work Light String with Plural—Normally Dual—Electrical Circuits

In another of its aspects the present invention is embodied in a work light string having plural—normally dual—electrical circuits.

The work light string includes (1) a cord/cable containing a plurality of electrical circuits; and (2) a plurality of lamps along the length of the cord/cable that are electrically connected to at least two different of the plurality of electrical circuits that are within the cord/cable. By this construction an electrical failure in one of the electrical circuits of the cord/cable will not effect those of the plurality of lamps that are electrically connected to any other one or ones of the electrical circuits.

Further, the plurality of lamps are preferably variably positionable, and re-positionable, along the length of the cord/cable.

The cord/cable preferably contains two electrical circuits. This cord/cable containing two electrical circuits preferably has at least three electrical conductors side-by-side: one outside conductor being a hot line of a first electrical circuit, the center conductor being an electrical neutral, and the remaining outside conductor being the hot line of a second electrical circuit separate from the first electrical circuit.

3. A Work Light String with Both (1) Variably-Positionable Lamps or Lights that (2) can be Electrically Connected Upon Plural—Normally Dual—Electrical Circuits In yet another of its aspects the present invention is embodied in a work light string having variably-positionable lamps or lights that connect to plural—normally dual—electrical circuits.

The preferred work light string includes (1) a cord/cable containing a plurality of separate electrical circuits; and (2) a plurality of assemblies, each holding one or more electric lamps, that are pluggable anywhere along the length of the cord/cable so as to become electrically connected to one of more of the plurality of electrical circuits that are within the cord/cable, one lamp per electrical circuit. By this construction an electrical failure in one of the electrical circuits of the cord/cable will not effect those of the plurality of lamps that are electrically connected to any other one or ones of the electrical circuits.

In detail of construction, the cord/cable pof the work light string most preferably contains two separate electrical circuits in a row: (1) a hot line conductor wire of a first electrical circuit, (2) a center conductor wire that is an electrical neutral, and (3) a remaining outside conductor wire that is the hot line of a second electrical circuit separate from the first electrical circuit. The plurality of assemblies that hold electric lamps are pluggable to this cord/cable containing two separate electrical circuits carried on three wires. The assemblies are so pluggable so that electrical insulation of the cord/cable is temporarily forcibly penetrated to make (1) electrical connection with the first electrical circuit only, or (2) with the second electrical circuit only, or (3) with both the first and the second electrical circuits where each circuit connects to but one electric lamp held by an assembly.

This work light string has a number of advantages. The assemblies and their held electric lamps can be so plugged anywhere along the length of the cord/cable. The assemblies so plugged may subsequently detached from the cord/cable whereupon the penetrated insulation of the cord/cable is self-healing and closes the penetration holes, leaving each and all of the cord/cable and the assemblies with their contained electric lamps suitable for re-use. Finally, a failure of a one electrical circuit does not cause failure of the electric lights of the work light string that are electrically connected to the other circuit, making that redundancy in lighting is provided by the work light string.

These and other aspects and attributes of the present invention will become increasingly clear upon reference to the following drawings and accompanying specification.

DESCRIPTION OF THE PREFERRED EMBODIMENT

Figure 1:
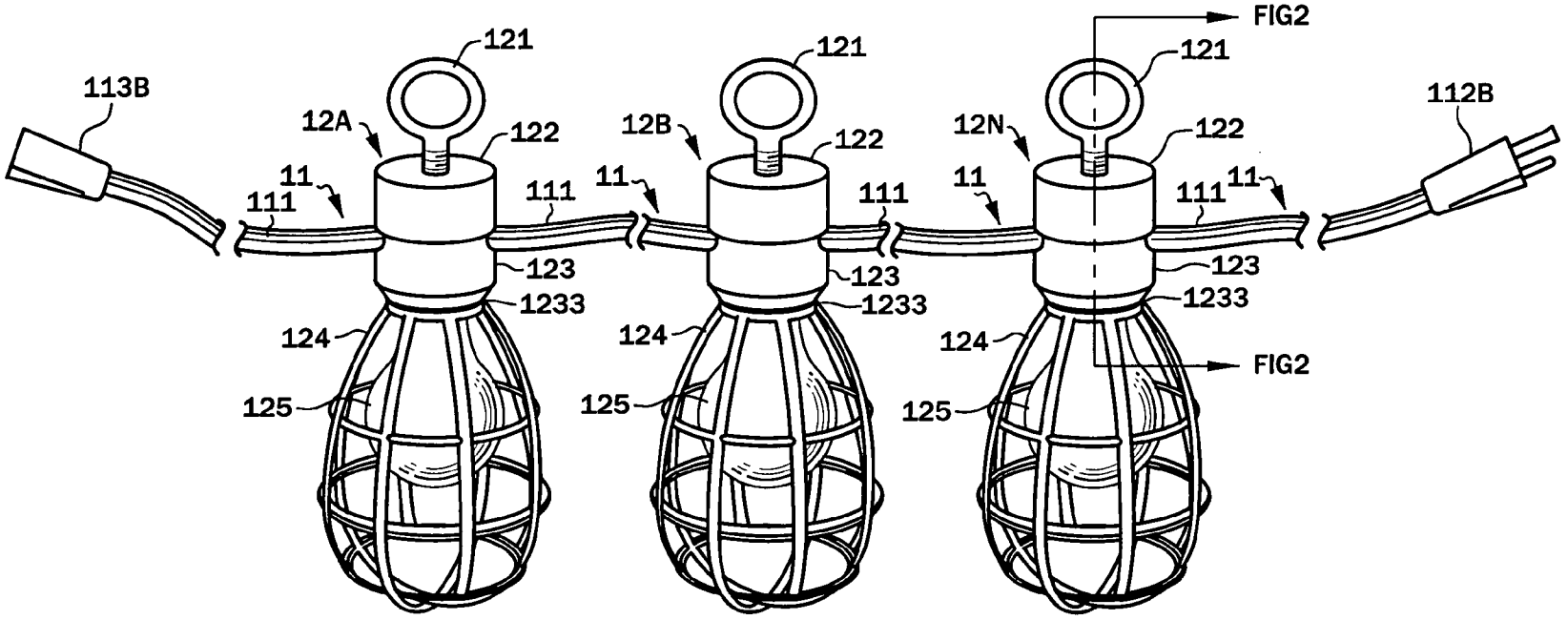
FIG. 1 is an diagrammatic view of a preferred embodiment of a work light string with variably positionable, re-positionable and replaceable lamps in accordance with the present invention.

A preferred embodiment of a work light string 1 with variably positionable, re-positionable and replaceable lamps 12 in accordance with the present invention is shown in diagrammatic view in FIG. 1.

The work light string 1 consists of a cable 11 proceeding from a first-end standard three-prong male electrical connector, or plug, 112B as to attach along its length a number of lamps—of which exemplary lamps 12A, 12B, . . . 12N are shown—to finally optionally terminate in a standard three prong female electrical connector, or plug, 113B. The cable 11 can electrically connect to, and communicate power ever but a single electrical circuit, but can alternatively connect to, and communicate electrical power over, two separate electrical circuits, as will be illustrated in conjunction with FIG. 3*c*. Namely, some of the lamps 12 can be oriented relative to the cable 11 so as to connect to a first electrical circuit therein, while other of the lamps 12 are reversed 180 degrees (relative to the cable 11) so as to connect to a second electrical circuit in the same cable.

In detail, when multiple electrical circuits are carried on the cable 11 then (1) a first electrical circuit is carried on internal conductors N (neutral) and L1 (line 1) of cable 11, meanwhile that (2) a second electrical circuit carried on internal conductors N (neutral) and L2 (line 1). An exemplary layout of these internal conductors L1, N and L2 will be shown in FIG. 3. A preferred cable 11 is type SEOW, and the three internal wires of this cable are arranged spaced-parallel in a plane within and across the flat cable 11, as illustrated in FIGS. 2 and 3.

Continuing in FIG. 1, each lamp 12 physically attaches and electrically connects anywhere along the length of cable 11 by physically screwing under the force of the hands and fingers. To connect a one circuit of the cable 11 to the lamp 12 the cable is laid in a slot across the width of middle assembly 123 of the lamp 12. Depending upon the orientation of this middle assembly 123 and the entire lamp 12 of which it is a part, the direction of cable 11 through a slot 1231 of assembly 123 will vary 180 degrees. Namely, either the internal conductors N and L1 of electrical circuit one, or else its internal conductors N and L2 of its electrical circuit two, will come to contact, and to power, the bulb 125 of each lamp 12 in a manner to be explained in conjunction with FIG. 2, next. It should be understood that, howsoever electrically connected, the lamps 12A, 12B, . . . 12N may be electrically connected anywhere along the length of the cable 12 as is required and/or desired by the job site illumination task to hand, and the number of lamps 12 required and/or desired. Normally no more than 10 lamps of maximum 100 watts each (or 4 to 5 amperes each lamp on a standard 120 v.a.c. electrical circuit) are attached to each single electrical circuit within the cable 11. Lamps 12 can normally be safely added, or removed, while the electrical power is on, as next discussed.

Figure 2:
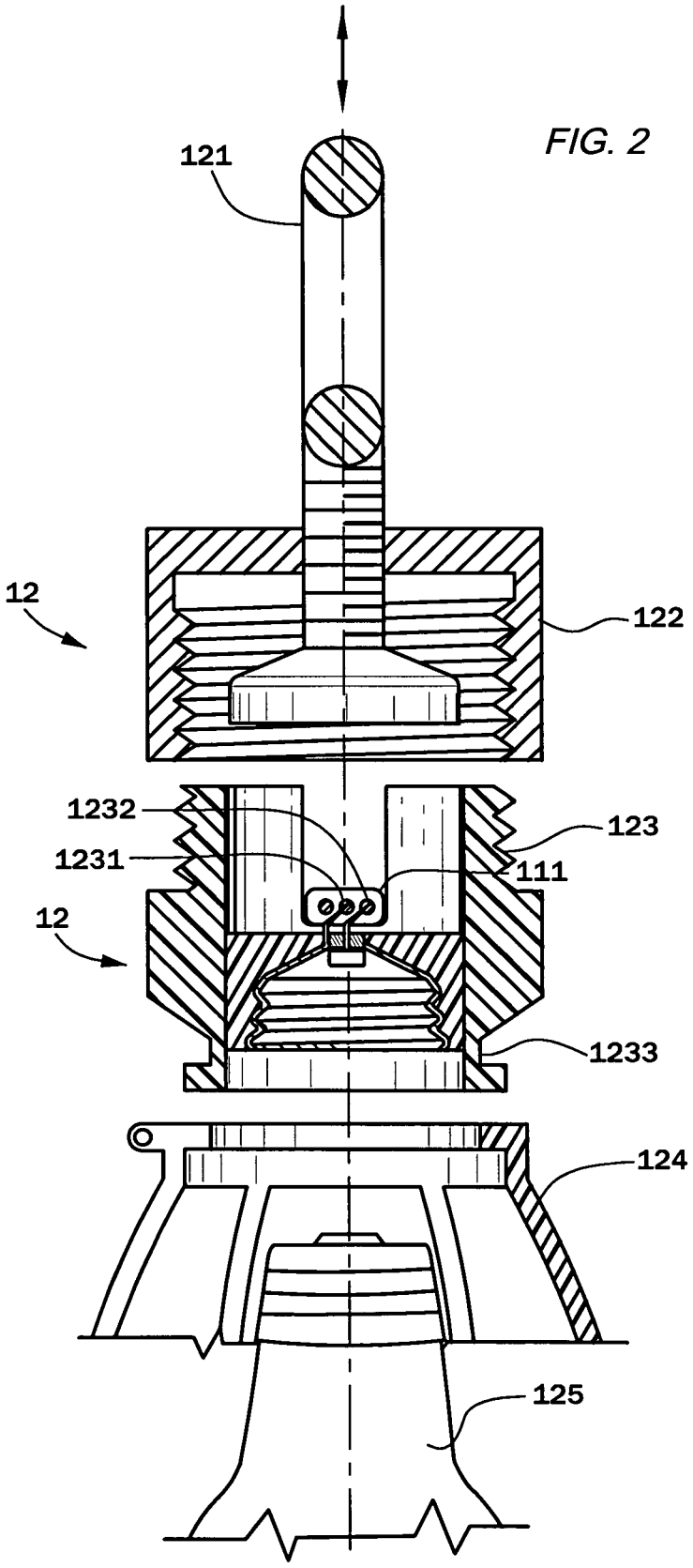
FIG. 2 is an exploded view, partially in cut-away, showing the internal structure of a variably positionable lamp of and in the preferred embodiment of a work light string in accordance with the present invention previously seen in FIG. 1.

Referring now to FIG. 2, an exploded view, partially in cut-away, showing the internal structure of a variably positionable lamp 12 of and in the preferred embodiment of a work light string 1 in accordance with the present invention (previously seen in FIG. 1) is shown therein. In mounting and assembly of the lamp 12 to the cable 11 at any position along the cable, the cable 11 is first positioned within an upper groove to the middle assembly 123. Then a top assembly 122 is screwed onto this middle assembly 123. The conductors N and LI of cable 11 are then finally forced into electrical contact with two sharp, insulation penetrating, protuberances within the channel of the middle assembly 123 by act of (1) screwing the top assembly 122 onto the middle assembly 123, so that (2) the portion of the bridal bridle ring 121 that is within the middle assembly 123 forces the N and L1 conductors (wires) of the cable 12 into physical and electrical contact with insulation-piercing metal pieces 1231, 1232.

The shaft of the bridle ring 121 may optionally be threaded, and received into a complimentary screw bore (not show) in the aperture where it passes through the top assembly 122. Still further alternatively, the shaft of the bridle ring 121 that is internal to the top assembly 122 may optionally be surrounded by a coil spring (not shown) acting to force the bridle ring 121 which is then not threaded, and which slips freely through the bore at the top of top assembly 122—down into middle assembly 123 and against the cable 11. These possible variations only show that a mechanical engineer can devise many alternatives to force the cable 11 and its conductors into the insulation-piercing metal pieces 1231, 1232 of the bottom assembly 123.

The bridle ring 121 of the top assembly 122 also serves as a convenient hanger of the lamp 12.

By this two-step screwing action the internal conductors 1231, or N; and 1232, or L1; that are within the cable 11 (which is within the groove of the middle assembly 123) are progressively forced by the base of the bridle ring 121 so as to ultimately make physical and electrical contact between these conductors and the insulation-piercing metal pieces 1231, 1232 of the bottom assembly 123. Then, in turn, these insulation-piercing metal pieces 1231, 1232 make electrical contact to the base and side of an Edison screw socket 1233 located at the base of middle assembly 123. An electric light bulb 125 (shown in phantom line for not being a part of the work light string 1 of the present invention) is positioned within a cage 124 (which may be of a snap open, screwed or other type as is conventional), and screwed into the Edison socket 1233.

To recapitulate, the assembly of a preferred embodiment lamp 12 of a work light string 1 in accordance with the present invention is shown in FIG. 2. The top assembly 122 is completely screwed to the bottom assembly 123, and the threaded bridle ring 124 is likewise held within the top assembly 121, catching and electrically connecting the cable 11 that is caught in the channel between the top assembly 122 and the bottom assembly 123. In this caught and connected position of the electrical cable 11, electrical connection is made to its conductors N (neutral) and L1 (line 1) of the cable 11 by insulation-penetrating metal pieces 1231, 1232. The electrical circuit (of a potential two such) within the cable 11 that is connected by these metal pieces 1231. 1232 depends upon the orientation of the cable 11 in the channel of the middle assembly 123. Electrical contact is made with a first electrical circuit carried on lines N and L 1 in a first orientation, and with a second electrical circuit carried on lines N and L2 in a second orientation. The one contacted circuit is conveyed from the metal pieces 1231, 1232 to the Edison socket 1233, and used to power any (replaceable) bulb 125 of any technology—i.e., incandescent, compact fluorescent, LED, etc.—that is screwed into the Edison socket 1233.

Notably, with power safely off, the bridle ring 124 may be loosened in the top assembly 122, and the top assembly 122 may be unscrewed from the bottom assembly 12 so as to loose the cable 11 unharmed and barely marked because its insulating cover is self-sealing. The entire lamp 12 may then be (1) set aside for re-use later, or (2) installed to a new position along the cable 11, as desired.

Figure 3A:
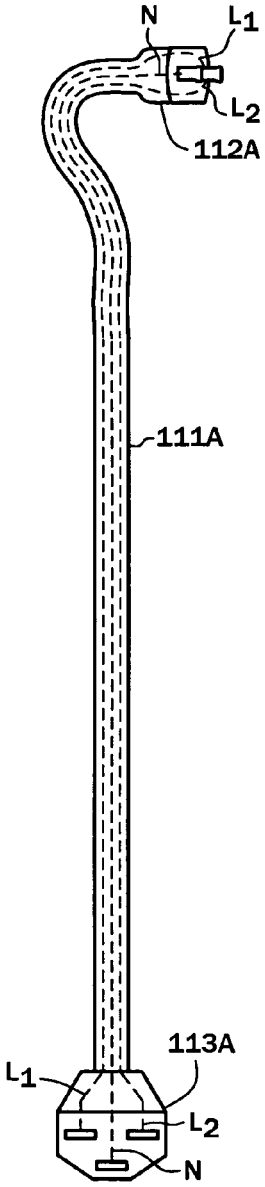
FIG. 3, consisting of FIGS. 3*a* through 3*c*, are diagrammatic views of alternative single- and dual-circuit embodiments of the cord of the preferred work light string in accordance with the present invention previously seen in FIGS. 1 and 2.
Figure 3B:
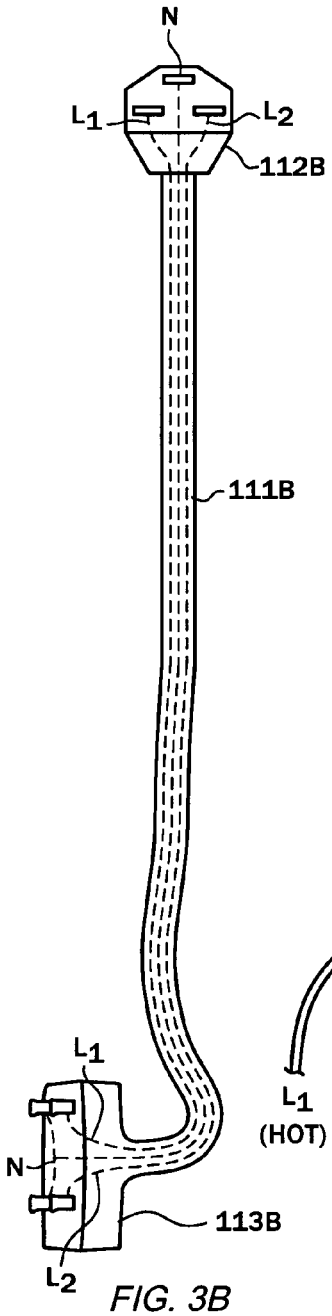
Figure 3C:
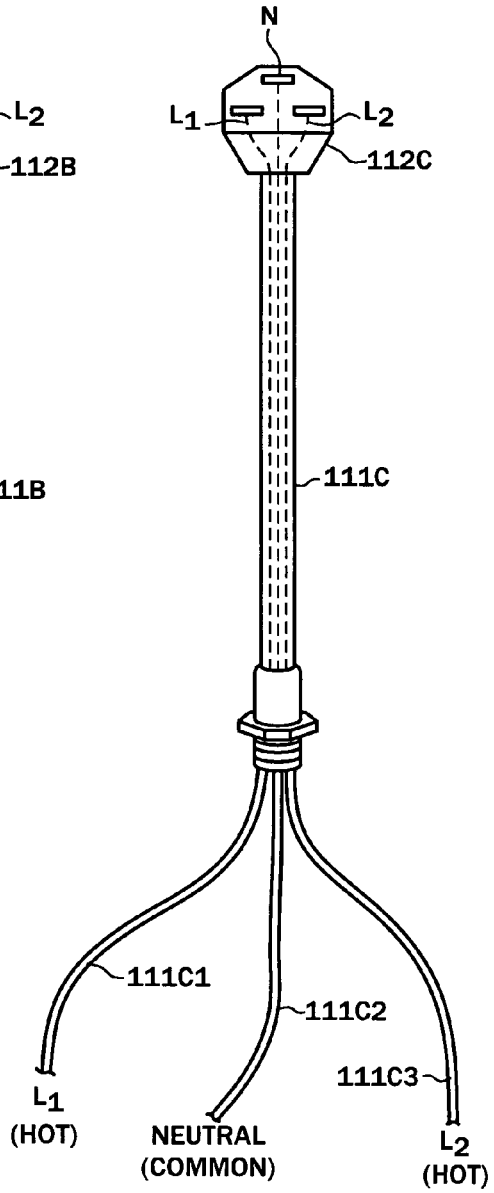

Diagrammatic views of alternative single- and dual-circuit embodiments of the cord of the preferred work light string in accordance with the present invention are shown in FIGS. 3*a* through 3*c*. In all cases a male plug is electrically equivalent to a female plug, which is why both are commonly called a "plugjack". A classic single-circuit three-conductor electrical cable 11*a* running between a single-circuit electrical plug 112*a* and an single-circuit electrical jack 113*a* is shown in FIG. 3*a*. The paths and connections of two circuit lines L1 and L2, and of the circuit neutral N, are shown.

A dual-circuit three-conductor electrical cable 111*b* running between a dual-circuit electrical jack 112*b* and an dual-circuit electrical plug 113*b* is shown in FIG. 3*b*. Remember, either end can be called a 'plugjack". The paths and connections of two circuit lines L1 and L2, and of the circuit neutral N, are shown.

Finally, a dual-circuit three-conductor electrical cable 111*c* now running betweenm, at a one end, the dual-circuit electrical plug 111*c* and, at the other end, dual-circuit electrical pigtails 111*c*1, 111*c*2, 111*c*3 is shown in FIG. 3*c*. Each of the two circuit lines L1 and L2, and the circuit neutral N, are brought out of the cable 111 into pigtails 111*c*1-111*c*3, as shown. The pigtails 111*c*1-111*c*3 provide an electrician with a convenient means for the connection of further electrical circuits and loads.

According to these variations, and still others within the skill of a practitioner of the electrical circuit and cord arts, the present invention should be considered in accordance with the following claims, only, and not solely on accordance with those embodiments within which the invention has been taught.

What is claimed is:

1. A work light string comprising of an electrical cable comprising three electrical conductors therein and a lamp with a bulb for connecting to the electrical cable, the lamp comprising:

a middle assembly comprising a first screw thread for receiving the bulb, two metal conductors for circuit connecting to the bulb, and two prongs each of which is electrically connected to one of the two metal conductors, a second screw thread, a channel extending longitudinally across and into the second screw thread wherein the two prongs are at a bottom of the channel and wherein the electrical cable is configured to be laid in the bottom of the channel on the two prongs;

a top assembly comprising a first screw thread and a second screw thread for threading engagement with the second screw thread of the middle assembly to engage and disengage the middle assembly from the top assembly; and a bridle ring having a first screw thread for threading engagement with the first screw thread of the top assembly, and a base at a bottom of the bridle ring, wherein the bridle ring is configured for threading the base of the bridle ring downward in the channel and pressing the cable onto the two prongs of the middle assembly so that each of the two prongs come into electrical contact with one of the three electrical conductors in the electrical cable.

2. The lamp of claim 1, and further comprising an axis extending through the lamp, wherein the first screw thread and the second screw thread of the middle assembly and the first screw thread and the second screw thread of the top assembly and the first screw thread of the bridle ring are co-axial with the axis.

3. The lamp of claim 1, wherein the top assembly is cylindrically shaped with a substantially flat top and an inner bore, wherein the first screw thread is centered in the top of the top assembly and communicates into the bore, and wherein the second screw thread is around an inner wall of the inner bore forming a female second screw thread, and wherein the second screw thread of the middle assembly is a male second screw thread and the middle assembly has a cylindrically shaped bore that extends downward toward the two prongs with a diameter smaller than a diameter of the male second screw thread and the channel extends longitudinally across and the second screw thread so that there is an interruption in the threads of the male second screw thread on each opposite sides of the male second screw thread so that the electrical cable can be laid down in the channel and extend outward on opposite sides of the middle assembly.

4. The lamp of claim 3, and further comprising the electrical cable, wherein the electrical cable is self-healing upon withdrawal of the two prongs, wherein the lamps is variably positionable, and re-positionable, and replaceable along a length of the electrical cable at a time after manufacture thereof without severing and splicing the electrical cable, such that the lamp can be re-oriented 180 degrees so that another combination of the two electrical conductors in the electrical cable engage the prongs.

* * * * *